US007795580B2

(12) United States Patent
Mukaibatake

(10) Patent No.: US 7,795,580 B2
(45) Date of Patent: Sep. 14, 2010

(54) SAMPLE INTRODUCTION DEVICE FOR MASS SPECTROMETER

(75) Inventor: Kazuo Mukaibatake, Kyoto (JP)

(73) Assignee: Shimadzu Corporation, Kyoto-Shi, Kyoto (JP)

( * ) Notice: Subject to any disclaimer, the term of this patent is extended or adjusted under 35 U.S.C. 154(b) by 184 days.

(21) Appl. No.: 12/081,523

(22) Filed: Apr. 17, 2008

(65) Prior Publication Data

US 2008/0283741 A1 Nov. 20, 2008

(30) Foreign Application Priority Data

May 14, 2007 (JP) ..... 2007-128125

(51) Int. Cl.
*H01J 49/00* (2006.01)

(52) U.S. Cl. ..... 250/288; 250/281; 250/282

(58) Field of Classification Search ..... 250/281–300
See application file for complete search history.

(56) References Cited

U.S. PATENT DOCUMENTS 4,000,654 A * 1/1977 Harris, Jr. ..... 73/863.81
4,121,465 A * 10/1978 Harris et al. ..... 73/863.81
6,319,410 B1 * 11/2001 Allington et al. ..... 210/634
2006/0263250 A1 * 11/2006 Blouin et al. ..... 422/63
2007/0057172 A1 * 3/2007 Wang ..... 250/281

* cited by examiner

*Primary Examiner*—Bernard E Souw
*Assistant Examiner*—Andrew Smyth
(74) *Attorney, Agent, or Firm*—Manabu Kanesaka

(57) ABSTRACT

A sample solution introduction device for a mass spectroscope includes a container device including a container having an opening at a top portion thereof and a blocking plug for blocking the opening, a gas supply device for supplying predetermined gas into the container, a first inner container provided inside the container, and an inner container supporting device for suspending and supporting the first inner container to the blocking plug. A liquid transmission pipe passes through the blocking plug. The liquid transmission pipe has one end to be soaked in a liquid sample inside the first inner container, and the other end located outside the container. The liquid sample is pushed by gas pressure supplied by the gas supply device.

5 Claims, 3 Drawing Sheets

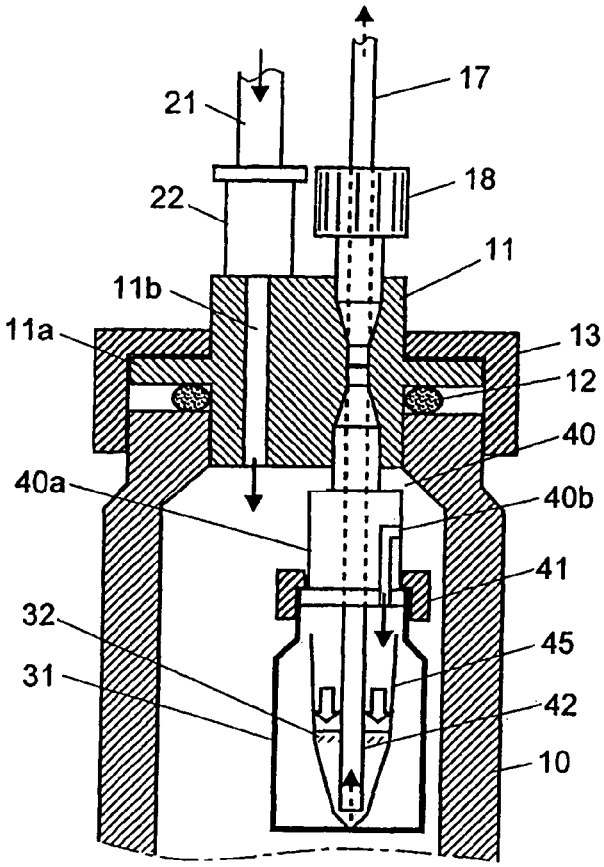
Fig. 3
Fig. 4
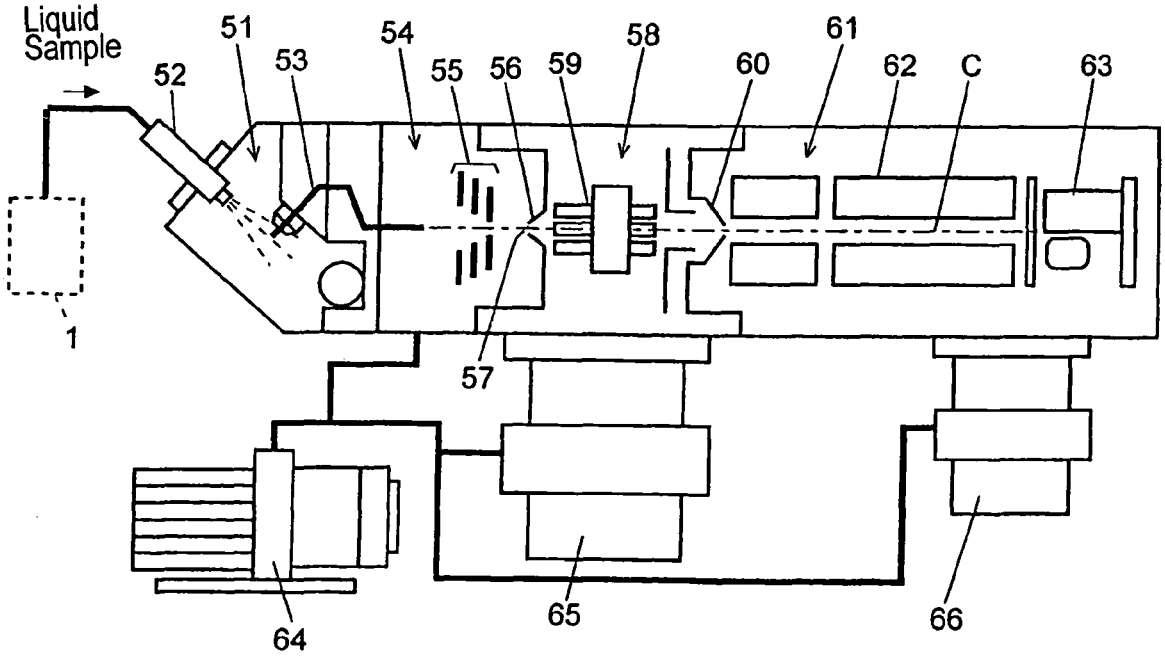

SAMPLE INTRODUCTION DEVICE FOR MASS SPECTROMETER

BACKGROUND OF THE INVENTION AND RELATED ART STATEMENT

The present invention relates to a mass spectrometer with an ion source wherein a liquid sample is ionized at atmospheric pressure, and more specifically, a sample introduction device wherein a liquid sample which is a subject of analysis is introduced into the ion source of the mass spectrometer.

In a liquid chromatograph mass spectrometer wherein a liquid chromatograph and a mass spectrometer are combined, in order to generate a gas ion from a liquid sample, generally, an atmospheric pressure ionization method such as an electrospray ionization method (ESI), atmospheric pressure chemical ionization method (APCI) and the like is used. When the object sample is analyzed, a sample introduction tube for the above-mentioned atmospheric pressure ionization mass spectrometer is connected to the end of a column of the liquid chromatograph, and the liquid sample whose components are separated by the chromatography column is introduced to an atmospheric pressure ion source of the mass spectrometer through the sample introduction tube.

On the other hand, in order to calibrate or adjust the mass spectrometer itself, a standard sample whose type and concentration are well-known is required to be analyzed. For that purpose, instead of a sample obtained from the chromatography column of the liquid chromatograph, the standard sample is required to be directly introduced to the ion source. This kind of direct liquid sample introduction method is generally called an infusion method. As an infusion method, a method wherein the liquid sample filled in a syringe is pumped by operations of a syringe pump and introduced to the mass spectrometer, is well-known (for example, refer to Patent Document 1: Japanese Patent Application Publication (TOKKAI) No. H9-159661).

This method is suitable for introducing a relatively small amount of liquid sample. On the other hand, since the liquid sample is required to be sucked into the syringe, or the syringe filled with the liquid sample is required to be set in the syringe pump, the operation takes extra time. A device described in the Patent Document 1 includes a structure which can connect the syringe and a sample container through a diversion valve, so that the above-mentioned operational inconvenience can be resolved. However, the size of the device relatively increases, so that the cost also increases.

On the other hand, as another infusion method, a method of sending the liquid sample by gas pressure is well-known (for example, refer to Patent Document 2: U.S. Pat. No. 5,703,360). FIG. 5 is a schematic structural view of a device which introduces a sample by gas pressure. A liquid sample 71 is retained inside a sealed container 70, and nitrogen gas is supplied to an upper space of the container 70 through a valve 73 provided in a gas introduction channel 72. At this time, the gas pressure inside the container 70 is monitored by a pressure sensor 74, and the opening and closing of the valve 73 are adjusted in such a way that the gas pressure maintains, for example, 100 kPa. The liquid sample inside the container 70 is pushed down by the gas pressure, so that in accordance with this movement, the liquid sample is sent through a sample introduction tube 75 whose one end is soaked (viz., immersed) in the liquid sample 71, and reaches a nozzle 52 of the mass spectrometer.

The above-mentioned method has a simple structure compared to the method using the syringe pump, and since an expensive component is not required, the cost can be moderate. However, relatively large amount of sample is required for a sample introduction. More specifically, in order to apply a pressure in the container 70 and send the liquid sample 71 which is retained in the container 70 as mentioned above, a gas introduction opening and a liquid derivation opening are required to be positioned in a plug portion which blocks the upper surface opening of the container 70. Therefore, structurally, the container 70 is required to have a certain size, and usually, in order to adequately send the liquid, approximately several tens of mL of liquid volume is required.

In the case of an inexpensive sample, the relatively large amount of sample as mentioned above can be easily prepared. However, in the case of an expensive sample or a sample without a standard sample such as a sample obtained by, for example, synthesis, purification, and extraction, in many cases, it is unrealistic to prepare the above-mentioned large amount of sample. Also, there is a sample marketed in a state of being preserved in a small-size vial bottle. If such a sample is preserved in another container or syringe, the sample will be inevitably wasted due to the amount remaining on the inner surface of the bottle or syringe.

The present invention has been made in order to solve the above-mentioned problem, and an object of this invention is to provide a mass spectrometer with a sample introduction device which can introduce a small amount of liquid sample to an ion source without wasting the liquid sample or increasing the cost to manufacture.

Further objects and advantages of the invention will be apparent from the following description of the invention.

SUMMARY OF THE INVENTION

The invention which has been made in order to solve the above-mentioned problem is a mass spectrometer comprising an ion source wherein a liquid sample is ionized under atmospheric pressure; and a sample introduction device wherein the liquid sample is introduced to the ion source. The sample introduction device comprises:

a) a sealed container including a container with an upper surface opening and a blocking plug blocking the upper surface opening;

b) a gas supply device for pumping predetermined gas into the sealed container;

c) a small-size container supporting device for suspending and supporting a small-size container which can be housed inside the container; and d) a liquid transmission pipe whose one end is soaked in the liquid sample inside the small-size container and the other end is located outside the container in order to send the liquid sample which is pushed by gas pressure supplied by the gas supply device in a state wherein the small-size container in which the liquid sample is housed is suspended and supported by the small-size container supporting device.

In the mass spectrometer of the invention, for example, the small-size container supporting device can comprise a holding portion holding the upper portion of the small-size container at the lower end of a rod-like or cylindrical member which is pressed into a hole situated in the blocking plug. Also, in this case, one portion (at least a part located inside the container) of the liquid transmission pipe can be a pipe line penetrated into the cylindrical member which is pressed into the hole situated in the blocking plug.

When the small-size container supporting device suspends and supports the small-size container, the inside of the small-size container and the inside of the sealed container are communicated through the opening formed in a plug, lid and so on which covers, for example, the upper surface opening of the small-size container. Therefore, when the small-size container in which the liquid sample is housed is suspended and supported by the small-size container supporting device, gas is supplied into the sealed container by the gas supply device. When the gas pressure inside the container increases, the gas pressure inside the small-size container also increases. Then, the liquid sample inside the small-size container is pressed down by the gas pressure, and the liquid sample is pressed up and elevated through the liquid transmission pipe and sent to the ion source of the mass spectrometer.

According to the mass spectrometer of the invention, a small amount of liquid sample, housed in the small-size container which has an inner volume significantly smaller than that of the sealed container, can be introduced to the ion source by pressurization. Herewith, without using a relatively expensive device such as a syringe pump, the small amount of liquid sample can be directly introduced, i.e. an infusion analysis can be carried out. Also, without transferring a commercially available sample (standard sample) and so on which is housed in a small-size vial bottle to another container, syringe and so on, the sample can be set inside the sealed container using the same small-size vial bottle, and provided for a sample introduction. Therefore, the sample can be effectively analyzed and can avoid to be wasted. Also, operation time can be saved.

BRIEF DESCRIPTION OF THE DRAWINGS

FIG. 3 is a schematic longitudinal sectional view of the upper part of the sealed container of the third embodiment of the sample introduction device included in the mass spectrometer according to the invention;

FIG. 4 is a schematic structural view of essential parts of the mass spectrometer of the embodiments.

DETAILED DESCRIPTION OF PREFERRED EMBODIMENTS

Figure 1:
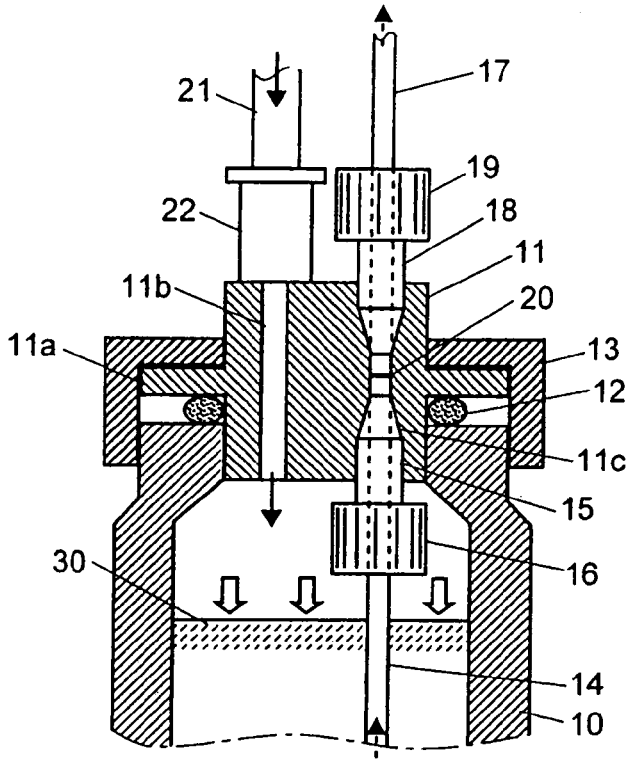
FIG. 1 is a schematic longitudinal sectional view of an upper part of a sealed container of the first embodiment of a sample introduction device included in a mass spectrometer according to the invention.

Hereunder, an electrospray ionization mass spectrometer which is one of the embodiments in the present invention will be described with reference to the attached drawings.

FIG. 4 is a schematic structural view of essential parts of the mass spectrometer of the embodiment. The mass spectrometer is provided with a first middle vacuum chamber 54 and a second middle vacuum chamber 58 which are respectively separated by a dividing wall. The first and second middle vacuum chambers 54, 58 are situated between an ionized chamber 51 wherein a nozzle 52 is disposed and connected to, for example, an outlet end of a column of a liquid chromatograph (not shown) and an analysis chamber 61 in which a quadrupole mass filter 62 and an ion detector 63 are disposed. The ionized chamber 51 and the first middle vacuum chamber 54 are communicated through a small diameter desolvation pipe 53, and the first middle vacuum chamber 54 and the second middle vacuum chamber 58 are communicated only through a skimmer 56 which includes a passage hole (orifice) 57 with a small diameter at the top portion.

The inside of the ionized chamber 51 is the ion source, and it has approximately atmospheric pressure (approximately $10^5$[Pa]) due to a vaporizing molecule of a liquid sample which is continuously supplied from the nozzle 52. The inside of the first middle vacuum chamber 54 is evacuated to a low-vacuum state with approximately $10^2$[Pa] by a rotary pump 64. Also, the inside of the second middle vacuum chamber 58 is evacuated to a medium-vacuum state with approximately $10^{-1}$~$10^{-2}$[Pa] by a turbo-molecular pump 65. The inside of the analysis chamber 61 is evacuated to a high-vacuum state with approximately $10^{-3}$~$10^{-4}$ [Pa] by another turbo-molecular pump 66. More specifically, by providing a structure with a multistep differential evacuation system wherein degree of vacuum is increased in stages from the ionized chamber 51 to the analysis chamber 61 on a chamber-to-chamber basis, the inside of the analysis chamber 61 can be maintained in the high-vacuum state.

An operation of the mass spectrometer will be briefly explained. The liquid sample is sprayed (electrosprayed) into the ionized chamber 51 while an electric charge is provided from the end of the nozzle 52, and a sample molecule is ionized in the process wherein a solvent in a droplet evaporates. The droplet wherein an ion is mixed is drawn into the desolvation pipe 53 by a differential pressure between the ionized chamber 51 and the first middle vacuum chamber 54. In the process that the droplet passes through the heated desolvation pipe 53, vaporization of the solvent is further accelerated, and then ionization is accelerated. A first lens electrode 55 is provided inside the first middle vacuum chamber 54, so that an electric field generated by means of the first lens electrode 55 assists in drawing the ion through the desolvation pipe 53, and converges the ion near the orifice 57 of the skimmer 56.

The ion, which is introduced into the second middle vacuum chamber 58 through the orifice 57, is converged by an octapole-type second lens electrode 59 which comprises eight rod electrodes, and sent to the analysis chamber 61. In the analysis chamber 61, only the ion including a specific mass (to be exact, mass to charge ratio) passes through a longitudinal space of the quadrupole mass filter 62, and the ion with the mass other than the above-mentioned specific mass is diverged along the way. The ion passed through the quadrupole mass filter 62 reaches the ion detector 63, and the ion detector 63 outputs an ion intensity signal according to the ion content.

Figure 5:
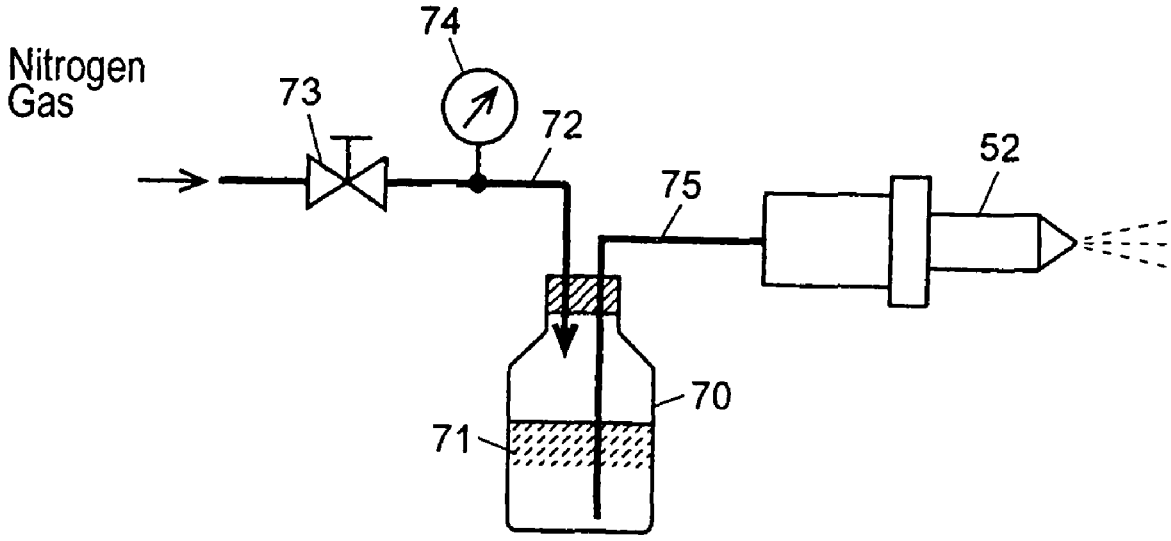
Fig 5 Prior Art
FIG. 5 is a schematic structural view of a device which introduces a sample to an ion source by pressurizing the sample.

When the mass spectrometer is calibrated or adjusted, as shown in FIG. 4, a sample introduction device 1 is connected to the front of the nozzle 52, a standard sample is directly introduced into the nozzle 52, and then a mass analysis is conducted. The sample introduction device 1 is a pressurized liquid transmission type as shown in FIG. 5 which has been already explained in the above. However, the sample introduction device 1 has a structure in such a way that the sample can be sent not only from the container with a large inside volume but even from a small-size container. Regarding this aspect, it will be explained with reference to FIGS. 1~3. All FIGS. 1~3 are schematic longitudinal sectional views of the upper portion of a sealed container in the sample introduction device 1 with which the mass spectrometer of the embodiment provides.

A sample bottle 10 with an inside volume of approximately several tens of mL (or more) includes a circular upper surface opening. Inside the upper surface opening of the sample bottle 10, an approximately cylindrical blocking plug 11 made of, for example, plastic is provided with a flange 11*a* which almost horizontally extends around the outer circumference of the cylindrical blocking plug 11. An annular sealing member 12 is sandwiched between the flange 11*a* and the upper border end portion of the sample bottle 10. Moreover, an annular cap 13 which includes a flat cylindrical portion on the outer circumferential border end is fixed on top of the blocking plug 11 by being screwed in the upper part of the sample bottle 10. By strongly fastening the cap 13, the sealing member 12 is compressed flatly, so that the sealing performance of the sample bottle 10 is further improved, and gas leakage at the time gas is supplied as described later can be reduced.

An approximately circular cylindrical communicating hole 11*b* is formed in the blocking plug 11 and penetrates above and below. At the top of the communicating hole 11*b*, a gas tube 21 is connected through a gas tube joint 22. In this way, predetermined gas (in this case, nitrogen gas) is supplied inside the sample bottle 10 through the gas tube 21 and the communicating hole 11*b*. Also, in the blocking plug 11, a communicating hole 11*c* is formed to respectively spread in a taper shape toward the upper side and lower side from approximately the middle of the blocking plug 11 in the vertical direction. A cylindrical pipe retentive member 18 is pressed into the communicating hole 11*c* from above. A sample introduction pipe 17 which reaches the nozzle 52 is provided inside the pipe retentive member 18, and fastened and fixed by a nut 19 in a state wherein the end face of the sample introduction pipe 17 projects to almost the middle of the vertical direction of the blocking plug 11.

Figure 2:
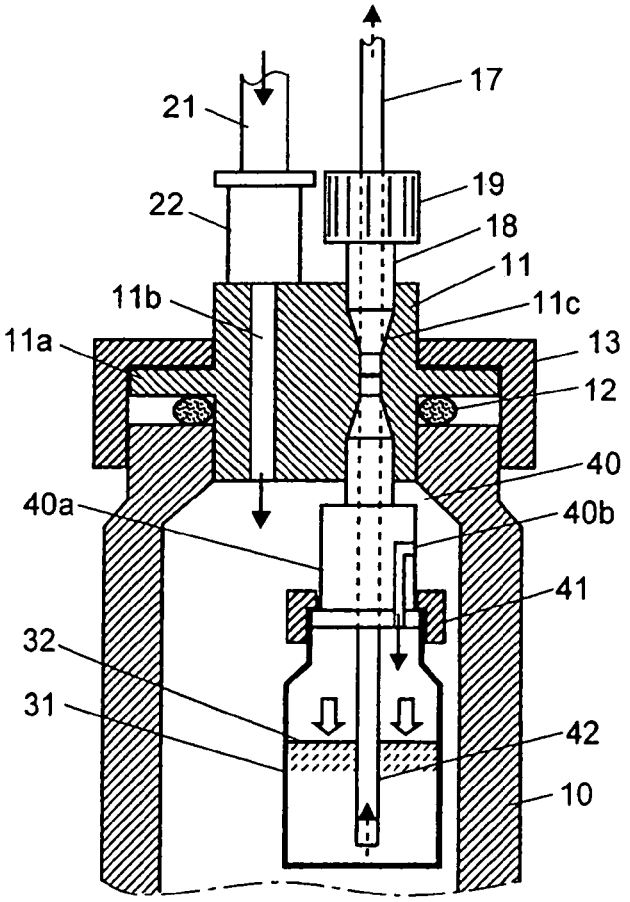
FIG. 2 is a schematic longitudinal sectional view of the upper part of the sealed container of the second embodiment of the sample introduction device included in the mass spectrometer according to the invention.

As shown in FIG. 1, in the case wherein a relatively large amount of liquid sample 30 housed inside the sample bottle 10 is pressurized and sent, a cylindrical pipe retentive member 15, which is the same as the pipe retentive member 18, is pressed into the communicating hole 11*c* from below. A sample suction pipe 14 whose lower end extends to the proximity of the inner bottom portion (not shown) of the sample bottle 10 is provided inside the pipe retentive member 15, and fastened and fixed by a nut 16 in a state wherein the upper end face of the sample suction pipe 14 projects to a vicinity of the middle, in the vertical direction, of the blocking plug 11. At this time, the upper end face of the sample suction pipe 14 and the lower surface of the sample introduction pipe 17 abut against each other at a position 20 inside the communicating hole 11*c*. Herewith, the sample suction pipe 14 and the sample introduction pipe 17 are substantively integrated, and form a liquid transmission pipe which extends from the inside of the sample bottle 10 to the nozzle 52.

In the state of FIG. 1, when nitrogen gas is supplied into the sample bottle 10 through the gas tube 21 and the communicating hole 11*b*, and the gas pressure inside the sample bottle 10 increases, as indicated by outline arrows in FIG. 1, a gas pressing force is provided to the liquid sample 30, so that the liquid sample 30 is elevated through the sample suction pipe 14, and sent to the nozzle 52 through the sample introduction pipe 17. This pressurized liquid transmission performance is the same as a conventional one.

In the case that liquid sample 32, housed in a small-sized sample vial 31 whose inside volume is approximately one to several mL, is pressurized and sent, as shown in FIG. 2, in stead of the pipe retentive member 15, a vial pipe retentive member 40 provided with a vial attachment adapter 40*a* at the bottom is used. The lower end of the vial attachment adapter 40*a* is inserted into the upper surface opening of the sample vial 31, and a nut 41 covered from the outside is screwed in the upper end of the sample vial 31, so that the sample vial 31 can be supported and suspended from the blocking plug 11. Also, a ventilation hole 40*b*, communicated with the side circumferential surface and the lower surface of the vial attachment adapter 40*a*, is formed in the vial attachment adapter 40*a*. The internal space of the sample vial 31 and the internal space of the sample bottle 10 are communicated to each other through the ventilation hole 40*b* in a state wherein the sample vial 31 is suspended and supported. Although the sample suction pipe 42 penetrates even into the vial pipe retentive member 40, the length of the sample suction pipe 42 is defined in such a way that the lower end of the sample suction pipe 42 is located near the inner bottom portion of the sample vial 31.

When nitrogen gas is supplied into the sample bottle 10 through the gas tube 21 and the communicating hole 11*b* in the state of FIG. 2, and the gas pressure inside the sample bottle 10 increases, the nitrogen gas is sent even to the internal space of the sample vial 31 through a ventilation hole 40*b*, so that the gas pressure inside the sample bottle 10 and the gas pressure inside the sample vial 31 become appropriately the same. In this way, as indicated by outline arrows in FIG. 2, a gas pressing force is provided to the liquid sample 32, so that the liquid sample 32 is elevated through the sample suction pipe 42, and sent to the nozzle 52 through the sample introduction pipe 17. More specifically, the liquid sample housed inside the sample vial 31 is sent into the ionized chamber 51 of the mass spectrometer, so that a mass analysis can be carried out.

Incidentally, in the case wherein multiple sizes of the sample vials 31 are used, the vial pipe retentive member 40 with the vial attachment adapter 40*a* may be prepared in accordance with the multiple sizes of the sample vials 31 and accordingly exchanged.

Depending on the circumstances, it may be required to use a less amount (for example, a μL order) of sample. In that case, as shown in FIG. 3, a sample vial 45 for the above-mentioned minimal amount of sample may be housed inside the sample vial 31 which is supported and suspended from the blocking plug 11. However, if the external diameter of the sample suction pipe 42 is large, the sample, which remains at the bottom of the sample vial 45 for the minimal amount of sample, may not be adequately sucked up. Therefore, in that case, a sample suction pipe which has a small external diameter at least at the lower end portion may be used.

Incidentally, the above-mentioned embodiments are examples of the present invention, and the invention includes other transformations, modifications and additions within a range of the main objective of the invention.

The disclosure of Japanese Patent Application No. 2007-128125, filed on May 14, 2007, is incorporated in the application.

While the invention has been explained with reference to the specific embodiments of the invention, the explanation is illustrative and the invention is limited only by the appended claims.

What is claimed is:

1. A sample solution introduction device for a mass spectrometer, comprising:

a container device including a container having an opening at a top portion thereof and a blocking plug blocking the opening;

a gas supply device for supplying a predetermined gas into the container;

a first inner container provided inside the container;

a ventilation hole for communicating the first inner container and the container;

a first inner container supporting device for suspending and supporting the first inner container to the blocking plug; and a liquid transmission pipe passing through the blocking plug and having one end to be immersed in a liquid sample inside the first inner container, and the other end located outside the container so that the liquid sample is pushed by gas pressure supplied into the first inner container through the ventilation hole from the container by the gas supply device.

2. A sample solution introduction device according to claim 1, wherein the first inner container supporting device is a vial attachment adapter attached to the blocking plug, through which the liquid transmission pipe enters the first inner container, the vial attachment adapter having a nut for connecting the first inner container.

3. A sample solution introduction device, for a mass spectrometer, comprising:

a container device including a container having an opening at a top portion thereof and a blocking plug blocking the opening;

a gas supply device for supplying a predetermined gas into the container;

a first inner container provided inside the container;

a first inner container supporting device for suspending and supporting the first inner container to the blocking plug and within the container;

a liquid transmission pipe passing through the blocking plug and having one end inside the first inner container, and the other end located outside the container;

wherein the first inner container supporting device is a vial attachment adapter attached to the blocking plug, through which the liquid transmission pipe enters the first inner container, the vial attachment adapter having a nut for connecting the first inner container and a ventilation hole for communicating the first inner container and the container, and a second inner container provided inside the first inner container, the one end of the liquid transmission pipe being immersed in a liquid sample in the second inner container so that the liquid sample is pushed through the liquid transmission pipe by gas pressure supplied by the gas supply device.

4. A sample solution introduction device according to claim 2, wherein the blocking plug further includes pipe retentive members attached to upper and lower portions of the blocking plug for holding the liquid transmission pipe.

5. A combination comprising the sample solution introduction device according to claim 1, and a mass spectrometer connected to the sample introduction device, said mass spectrometer comprising an ionized chamber, an ion source provided in the ionized chamber for ionizing a liquid sample at an atmospheric pressure, a first middle vacuum chamber attached to the ionized chamber, a first pump for evacuating the first middle vacuum chamber, a second middle vacuum chamber attached to the first middle vacuum chamber, a second pump for evacuating the second middle vacuum chamber, and an analysis chamber attached to the second middle vacuum chamber.

* * * * *